United States Patent [19]

Horne

[11] 4,082,083

[45] Apr. 4, 1978

[54] NON-POLLUTING TAR KETTLE ASSEMBLY

[76] Inventor: Monroe D. Horne, 4161 Cherokee Ave., San Diego, Calif. 92104

[21] Appl. No.: 759,818

[22] Filed: Jan. 17, 1977

[51] Int. Cl.[2] ..... E01C 19/45

[52] U.S. Cl. ..... 126/343.5 A; 214/17 B

[58] Field of Search ..... 37/12; 266/165, 205, 266/901; 126/343.5 R, 343.5 A; 214/17 B

[56] References Cited

U.S. PATENT DOCUMENTS

| | | | |
|---|---|---|---|
| 1,875,921 | 9/1932 | Grant et al. | 214/17 B |
| 2,321,908 | 6/1943 | Gerlinger | 126/343.5 A |
| 3,386,435 | 6/1968 | Heller | 126/343.5 A |
| 3,633,770 | 1/1972 | Howard | 214/17 B |
| 3,773,193 | 11/1973 | McClure | 214/17 B |
| 3,995,616 | 12/1976 | Schrader | 126/343.5 A |
| 4,015,588 | 4/1977 | Blackwell | 126/343.5 A |
| 4,033,328 | 7/1977 | Lohman et al. | 126/343.5 A |

*Primary Examiner*—Ronald C. Capossela

*Attorney, Agent, or Firm*—Roy L. Knox

[57] ABSTRACT

An improved tar kettle wherein the asphalt or tar is subjected to controlled heating in a closed space so that there is no significant production and escape of fumes, the kettle having a charging cylinder, telescopically mounted within a fixed cylinder on the top of the kettle, to be withdrawn outwardly to receive a charge of solid asphalt and then to be pushed back into the fixed cylinder and rotated through 180° to bring a loading-discharge opening in the charging cylinder into alignment with an opening in the fixed cylinder leading into the tar kettle and thus unloading the asphalt into the kettle without opening the kettle or allowing fumes to escape and also limiting the admission of fresh air into the kettle in order to minimize likelihood of flash fires, the kettle having a combination safety door and baffle, openable in the event of pressure build-up due to any such fire.

8 Claims, 5 Drawing Figures

NON-POLLUTING TAR KETTLE ASSEMBLY

BACKGROUND OF THE INVENTION

Tar kettles in the prior art have been provided with doors in the top thereof, which doors are opened to permit recharging of the kettle by workmen dropping in chunks of asphalt which have been broken by an axe from wrapped cylinders of asphalt. Even reasonably careful dropping of these chunks into the hot tar in the kettle causes splashing and the free access of air results in the tar frequently catching on fire. Such kettles have no provision against emanation of fumes and are dangerous to operate. Proposals have been made to relocate the doors on tar kettles and very satisfactory temperature sensing apparatus have been incorporated in kettles to minimize overheating and the danger of fire. The present invention is incorporated with a tar kettle which may be already equipped with such temperature sensing and control apparatus. There is a need, however for improvements making such a tar kettle safer and more easily operated as well as non-polluting.

SUMMARY OF THE INVENTION

As claimed, this invention satisfactorily meets the immediately abovementioned need by providing a tar kettle with top closure means for virtually eliminating the escape of fumes and safety loading means permitting charging solid asphalt into the kettle with minimal influx of air into kettle so that hot tar therein, deprived of oxygen, will not start or continue to burn, it being understood that proper temperature control means is provided, and in the unlikely event that a flash fire does occur the safety door provided according to this invention will safely vent any exploding gases and then automatically close again, the charging means being manually operable and configured for minimal prior preparation of the solid asphalt and having simple locking means.

DETAILED DESCRIPTION OF A PREFERRED EMBODIMENT

Figure 1:
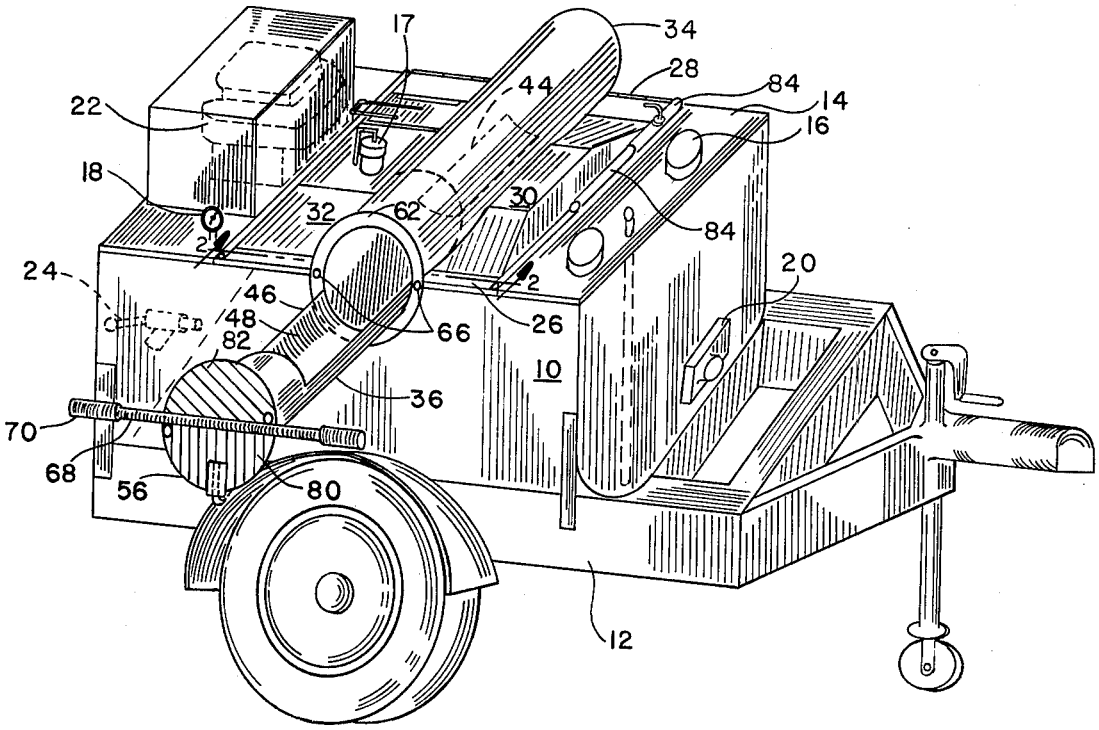
FIG. 1 is a view, largely isometric in character, showing the improved charging means and safety features combined in an ambulant tar kettle with prior art features such as a thermostatically controlled heater and hot tar pump-out means shown diagrammatically.

As illustrated, the safety loader is used with a prior art environment which is not greatly altered, namely, a tar-receiving kettle 10 usually mounted on an ambulant frame 12 and having a generally flat top closure panel 14. In the front end portion of the kettle assembly a conventional tar heater is housed and the heater and kettle are vented at 16 and 17. A thermometer 18 and a thermostat 20 are important elements in the broad combination claimed as this invention but these elements may also be of conventional design, provided only that the thermostat shall be accurately functional since the operating temperature must be carefully controlled within a range insuring proper melting of the asphalt but not exceeding the ignition temperature thereof. At the opposite end portion of the tar-receiving kettle a power driven pump assembly 22 is somewhat diagrammatically illustrated, this assembly being also conventional and commonly used to pump the hot tar out through a valved outlet 24 which may, in practice, be connected to a flexible hose and an outlet nozzle, not shown in the drawing.

According to the instant invention, a major portion hereinafter referred to as the lid portion 26 of the closure panel 14, said lid portion 26 being hinged as at 28 to what may be considered the remote top edge, as viewed in FIG. 1, of the tar kettle. As illustrated, the lid portion 26 has opposing canopies 30 – 32 which are integral upraised portions of the lid and which are configured to define a seat therebetween for the hollow fixed cylinder 34. It will be understood that the lid portion with its canopies 30 – 32 and fixed cylinder 34, along with the charger cylinder 36 hereinafter described, all are pivotally shiftable about the horizontal axis of the hinge 28 to give access to the interior of the tar kettle but this is primarily for maintenance only and is not required in the normal operation of the apparatus. In fact, the tar kettle is best regarded as essentially sealed and the lid portion 26 is marginally sealed by a peripheral strip of asbestos 38 supported by a channel 40 on the underside of the lid portion at the margin thereof as clearly illustrated in FIG. 2. A upstanding rail 42, which may be a simple angle iron, is secured to the closure panel 14 in opposing relation to the peripheral strip 38 to effect the sealing of the lid portion 26.

Figure 2:
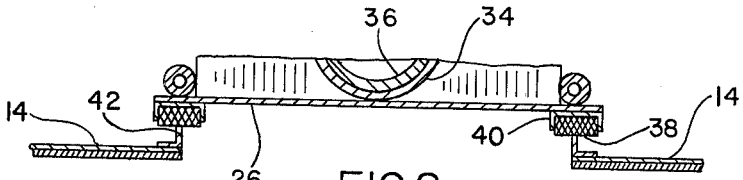
FIG. 2 is a sectional view taken on the line 2—2 in FIG. 1 to illustrate the sealing of the closure panel when in closed position on top of the tar kettle.
Figure 3:
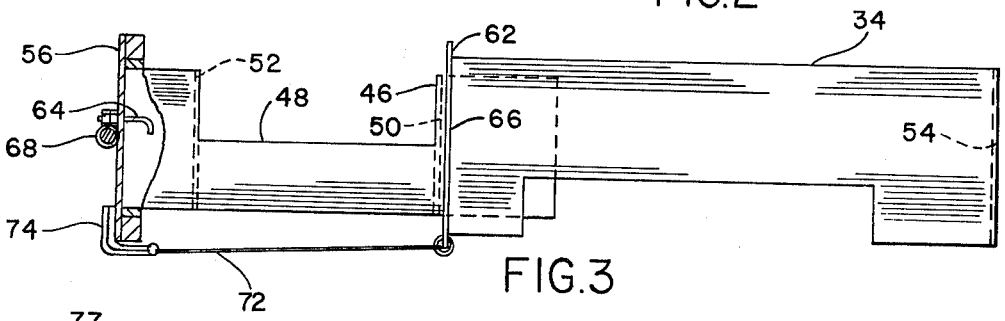
FIG. 3 is a detail view of the fixed and sliding cylinders, in elevation except for the front plate of the latter and associated parts which are partly in section.
Figure 4:
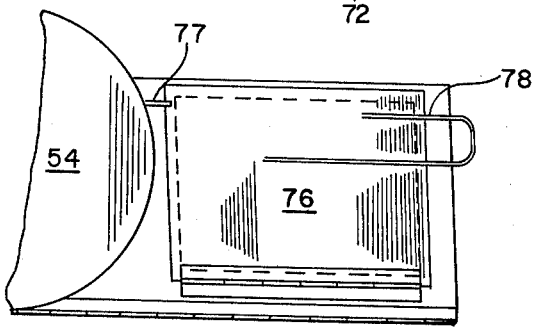
FIG. 4 is an elevational view of the safety door and fragmentary portions of adjacent structure, namely, the closed rear end of the fixed cylinder and canopy on the closure panel as viewed from the remote side of FIG. 1.
Figure 5:
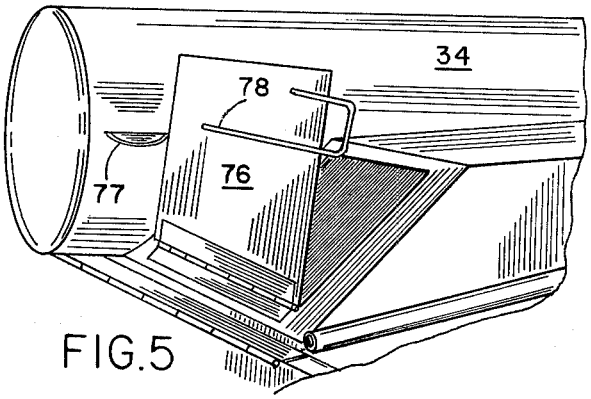
FIG. 5 is a perspective view of substantially the same structure as FIG. 4, showing the safety door in open position.

The charge cylinder 36 is reasonably snugly and telescopically associated with the fixed cylinder 34 as illustrated in FIGS. 1, 2 and 3 and will ordinarily be of comparable length therewith since a considerable portion thereof, as illustrated at 44, will function as terminal support for the charging cylinder when the same is extended as in FIGS. 1 and 3. The charging cylinder 36 is, of course, hollow and is cut-away as at 38 to define a trough 40 ideally configured to receive asphalt which ordinarily is merchandised in short rolls.

The ends of the trough 40 are closed by circular plates 50 and 52 and the remote end of the fixed cylinder 34 is also closed as indicated at 54 to prevent escape of fumes. A face plate 56 is secured to the outer end of charger cylinder 36 and circular strip of asbestos, supported on a rim secured to the face plate, seals the charger cylinder against an annular flange 62 on the fixed cylinder 34 when the charger cylinder is pushed in as in the charging step. It will be understood that in charging the asphalt into the kettle, the asphalt laden cylinder 36 is manually pushed into the fixed cylinder 34 and rotated 180° so that the asphalt falls out of the trough 48 into the kettle. To lock the cylinder 36 in this closed position there is provided a pair of hook members 64 which enter the arcuate slots 66 in the flange 62 and lock when the cylinder 36 is rotated slightly in its fully closed position.

A handbar 68 is secured to the face plate 56 and extended diametrically and equipped with hand-holds 70, to permit manual handling of the charger cylinder. The face plate is provided with visual means to indicate the proper loading and discharge positions, as by painting one half of the face plate green and the other half red and this visual means is of course related to the position of the trough 48 and handbar 68.

To prevent inadvertent total withdrawal of the charging cylinder, a flexible cable 72 is terminally secured to the flange 62 and to a bracket 74 on the face plate 56.

Finally, a safety door 76 is hingedly mounted to a portion of the apparatus remote from the point where workmen operate the charging cylinder 36. As illustrated this door 76 is hinged to a lower edge portion of a rear face of the canopy 32. The door is weighted to close automatically and will remain closed normally but in the event of undue pressure build-up in the kettle this door will open against its stop 77 to relieve that pressure. Since flames from burning asphalt are a possibility, the door is thus disposed to act as a baffle deflecting the flames harmlessly upward away from personnel either at the front or back of the apparatus. A handle 78 on the door facilitates intentional opening of this door when desired.

The safety features incorporated into this invention will be noted as including, aside from the immediately above mentioned door 76, a positive guarantee against disengagement of the charging cylinder, namely, the cable 72, the coloring of the face plate 56 as indicated at 80 and 82, the thermally non-conducting hand-holds 70. The provision of plates 50 and 34 to prevent escape of fumes, and the basic concept of prevention of fumes escaping at any stage of operation of the apparatus are also safety considerations as well as being anti-pollutant in nature. The extensible hand levers 84, ordinarily retained in cylinders 86, enable the tilting of the lid portion 26 about hinge 28 with safety to personnel when access to the kettle interior must be gained.

In brief, the above described apparatus, when operated within proper temperature limits, as monitored by proper use of the thermostat 20, dip stick 88 and thermometer 18, will prevent pollution and the safety features will prevent accidents. By excluding any great amount of fresh air from the hot tar even when recharging the likelihood of the tar catching on fire is virtually eliminated. Finally, a further advantage will now be evident, namely, a considerable saving in heating fuel because the kettle remains closed during operation and the cooling experienced when prior art kettles are opened for recharging is avoided.

What I claim as new and desire to secure by Letters Patent is:

1. An improved tar kettle assembly, comprising:

a. a tar-receiving kettle having heating means, tar temperature sensing and control means and hot liquid tar pump-out means;

b. a safety loader, for charging solid asphalt into said kettle, comprising:

1. a closure panel closing the top of said kettle, said panel having a lid portion;
2. a hollow fixed cylinder integrated with the top of said lid portion, the lower part of said cylinder and the adjacent part of said lid portion having a common opening therein communicating with the interior of the kettle;
3. a charger cylinder telescopically and reasonably snugly mounted in said fixed cylinder and being essentially a hollow cylinder having a cut-away portion intermediate the length thereof to permit lading asphalt thereinto when the charger cylinder is extended, and said cut-away portion being functional as a discharge opening communicating with said opening in the lower part of the fixed cylinder, the ends of the cut-away portion being closed so that, when extended as well as when telescoped into said fixed cylinder and rotated to discharging position, said charger cylinder effectively closes said opening in the fixed cylinder;
4. and means for manipulating said charger cylinder.

2. An improved tar kettle assembly according to claim 1 and including a safety door at the top of said kettle and at the side thereof remote from said means for manipulating the charger, said door being weighted to remain closed under normal conditions and hinged to open upwardly, to relieve dangerously high pressure within said kettle.

3. An improved tar kettle assembly according to claim 2 and including means to limit the upward opening movement of said safety door to a position upwardly inclined away from said means for manipulating the charger, whereby the safety door then constitutes a shielding baffle to direct flames from any burning asphalt substantially vertically upward and then away from passers-by as well as operating personnel.

4. An improved tar kettle assembly according to claim 1 wherein said means for manipulating said charger cylinder is a handbar secured upon one end of said charger cylinder.

5. An improved tar kettle assembly according to claim 1 and including safety means to limit the extension of said charger cylinder.

6. An improved tar kettle asembly according to claim 1 and including means to lock said charger cylinder in said discharging position.

7. An improved tar kettle assembly according to claim 6 wherein said means to lock comprises catch means on said cylinders which inter-engage when the charging cylinder is rotated into said discharging position.

8. An improved tar kettle assembly according to claim 1 wherein said lid portion is marginally sealed to the top of said kettle and hinged thereto so that the lid portion panel and said cylinders can be swung open as a unit for maintenance purposes.

* * * * *